US005997382A

United States Patent [19]

Sasamori et al.

[11] Patent Number: 5,997,382

[45] Date of Patent: Dec. 7, 1999

[54] METHOD OF PROCESSING SEALING SURFACE OF CASTING AND GRINDSTONE SUITABLE FOR USE THEREIN

[75] Inventors: Takefusa Sasamori; Motoshi Nakamura; Morihiro Sawada; Kazuya Nakata; Masafumi Yamaguchi, all of Toyota, Japan

[73] Assignee: Toyota Jidosha Kabushiki Kaisha, Toyota, Japan

[21] Appl. No.: 09/002,503

[22] Filed: Jan. 2, 1998

[30] Foreign Application Priority Data

Jan. 23, 1997 [JP] Japan ..... 9-010603

[51] Int. Cl.[6] ..... B24B 1/00

[52] U.S. Cl. ..... 451/28; 451/41; 451/548

[58] Field of Search ..... 451/41, 548

[56] References Cited

U.S. PATENT DOCUMENTS

| | | |
|---|---|---|
| 1,286,379 | 12/1918 | Mathias . |
| 3,606,785 | 9/1971 | Olsson . |
| 3,954,514 | 5/1976 | Webster et al. . |
| 4,250,610 | 2/1981 | Wilbers et al. . |
| 5,311,655 | 5/1994 | Jager et al. . |
| 5,442,847 | 8/1995 | Semiatin et al. . |
| 5,443,201 | 8/1995 | Cartry . |
| 5,578,099 | 11/1996 | Neff ..... 451/529 |

FOREIGN PATENT DOCUMENTS

| | | |
|---|---|---|
| 0 137 684 | 4/1985 | European Pat. Off. . |
| 0 180 935 | 5/1986 | European Pat. Off. . |
| 63-62667 | 4/1988 | Japan . |
| 1-218733 | 8/1989 | Japan . |
| 8-170716 | 7/1996 | Japan . |
| 567281 | 2/1945 | United Kingdom . |
| 1528210 | 10/1978 | United Kingdom . |
| 2014071 | 8/1979 | United Kingdom . |

OTHER PUBLICATIONS

Derwent Abstracts, Accession No. 81–86020D/198147, JP 56–128635, Oct. 8, 1981.

*Primary Examiner*—David A. Scherbel
*Assistant Examiner*—Shantese McDonald
*Attorney, Agent, or Firm*—Oblon, Spivak, McClelland, Maier & Neustadt, P.C.

[57] ABSTRACT

In a method of processing a sealing surface of a casting to eliminate casting defects on or in the vicinity of the sealing surface, each of abrasive grains constituting a grindstone has a flat face formed on its distal end. The sealing surface of the casting is ground by the grindstone while the flat face of each abrasive grain is held parallel to the sealing surface of the casting. Consequently, a plastic flow layer is formed on the sealing surface of the casting. Blowholes present within a predetermined range of depth of the casting from the sealing surface are collapsed as the result of formation of the plastic flow layer.

4 Claims, 11 Drawing Sheets

DIAMOND GRIDING & PRESSING

DIAMOND GRIDING & PRESSING

METHOD OF PROCESSING SEALING SURFACE OF CASTING AND GRINDSTONE SUITABLE FOR USE THEREIN

BACKGROUND OF THE INVENTION

1. Field of the Invention

This invention relates to a method of processing a sealing surface of a casting to eliminate casting defects present on or in the vicinity of the sealing surface for an improvement in the sealing performance, and further to a grindstone suitable for use in the method.

2. Description of the Prior Art

Cylinder blocks for internal combustion engines are generally made by casting a metal, for example. One surface of a casting is finished to serve as a sealing surface. A sealing member such as a gasket is attached to the sealing surface of the casting, and a sealing surface of another member such as a cylinder head is pressed against the attached sealing member so that the two members, that is, the casting and the another member are airtightly assembled together. If a casting defect is present on the sealing surface or in the vicinity thereof, airtightness and accordingly, the sealing performance between the two members will be reduced.

Chemicals are conventionally applied to the sealing surface of the casting to prevent the reduction in the sealing performance due to the casting defects present on the sealing surface or in the vicinity thereof. The chemicals are penetrated into the casting defects such as blowholes so that the casting defects are filled up or impregnated with the chemicals.

However, it is sometimes difficult to impregnate the casting defect with the chemicals depending upon its size, configuration, etc. Furthermore, it is difficult to eliminate the casting defects of the casting used under high temperature conditions, for example, the engine cylinder block.

SUMMARY OF THE INVENTION

Therefore, an object of the present invention is to secure a sufficient sealing performance of the sealing surface of the casting used under high temperature conditions.

Another object of the invention is to broaden or ease the conditions of size, configuration, etc. of the casting defect which can be eliminated.

Further another object of the invention is to accomplish a processing which can simultaneously provide finishing for the sealing surface of the casting and elimination of the casting defects from the casting. One form of the present invention provides a novel grindstone used to accomplish the processing.

Further another object of the invention is to accomplish a method of processing the sealing surface of the casting wherein a desired sealing performance can be achieved by application of a small processing force.

In one aspect, the present invention provides a method of processing a sealing surface of a casting to eliminate casting defects on or in the vicinity thereof, the method comprising the step of pressing a grindstone against the sealing surface while the grindstone is being rotated, the grindstone being abutted against the sealing surface so that distal end surfaces of abrasive grains of the grindstone are held approximately parallel to the sealing surface.

According to the above-described method, the sealing surface of the casting is ground, being scraped by the flat distal end surfaces of the abrasive grains. The sealing surface is simultaneously ground and pressed such that a plastic flow layer is formed on the sealing surface. The plastic flow herein refers to "pressurizing a metal so that the metal slightly flows in a direction of pressure application." Upon occurrence of the plastic flow, blowholes present within a predetermined range of the depth of the casting from the sealing surface are effectively collapsed. Thus, since the plastic flow layer is formed on the sealing surface so that the blowholes are collapsed, the casting defects present in the casting used under the high temperature conditions can effectively be eliminated. Furthermore, shrinkage cavities can also be eliminated to a certain extent of their sizes regardless of their configurations. Additionally, since the hardness of the sealing surface is increased about 30 Hv as the result of the surface plastic flow, the sealing surface can be prevented from being worn out and accordingly, a reduction in the sealing performance can be prevented.

The above-described method is carried out with use of a grindstone which comprises a generally circular support plate and a plurality of abrasive grains fixed to one side of the support plate, each abrasive grain having a distal end surface parallel to the support plate, all the abrasive grains being co-planar with one another. According to the grindstone, the sealing surface is simultaneously ground and pressed.

In another aspect, the invention provides a method of processing a sealing surface of a casting to eliminate casting defects on or in the vicinity thereof, the method comprising the steps of pressing a pressing member against the sealing surface, and moving the pressing member along a line in contact with a seal line of a sealing member while the pressing member is being pressed against the sealing surface. According to this method, a desired sealing performance can be achieved by application of a small processing force.

According to the present invention, the casting defects present in the casting used under the high temperature conditions can reliably be eliminated since the blowholes present within a predetermined range of the depth of the casting from the sealing surface are effectively collapsed. Furthermore, even shrinkage cavities can be eliminated to a certain extent of their sizes regardless of their configurations. Consequently, since casting products are prevented from being adversely affected by the casting defects, the yield of casting products can be improved.

The invention will be understood better upon a reading of the following detailed description of the preferred embodiments and claims with reference to the accompanying drawings.

DETAILED DESCRIPTION OF THE PREFERRED EMBODIMENTS

First Embodiment

Figure 1:
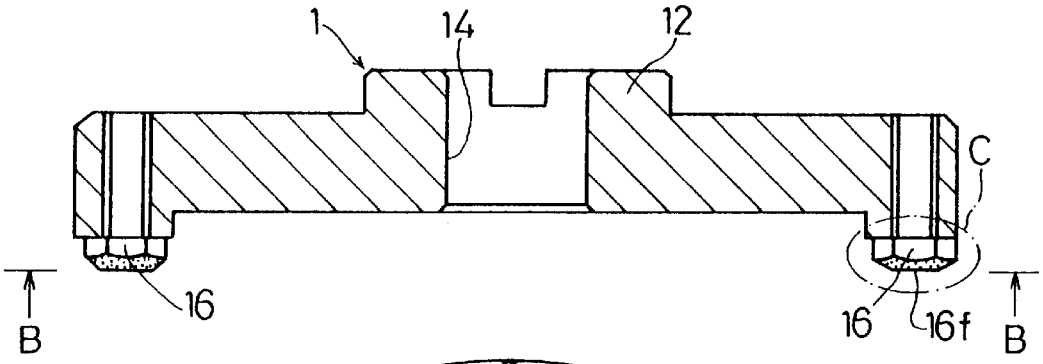
FIG. 1(A) is a longitudinal section of the grindstone used in the method of a first embodiment in accordance with the present invention.
FIG. 1(B) is a view of the grindstone as viewed in the direction of arrows B in FIG. 1(A)
FIG. 1(C) illustrates portion C in FIG. 1(A) in detail.
FIG. 1(D) illustrates portion D in FIG. 1(C) in detail.
Figure 1:
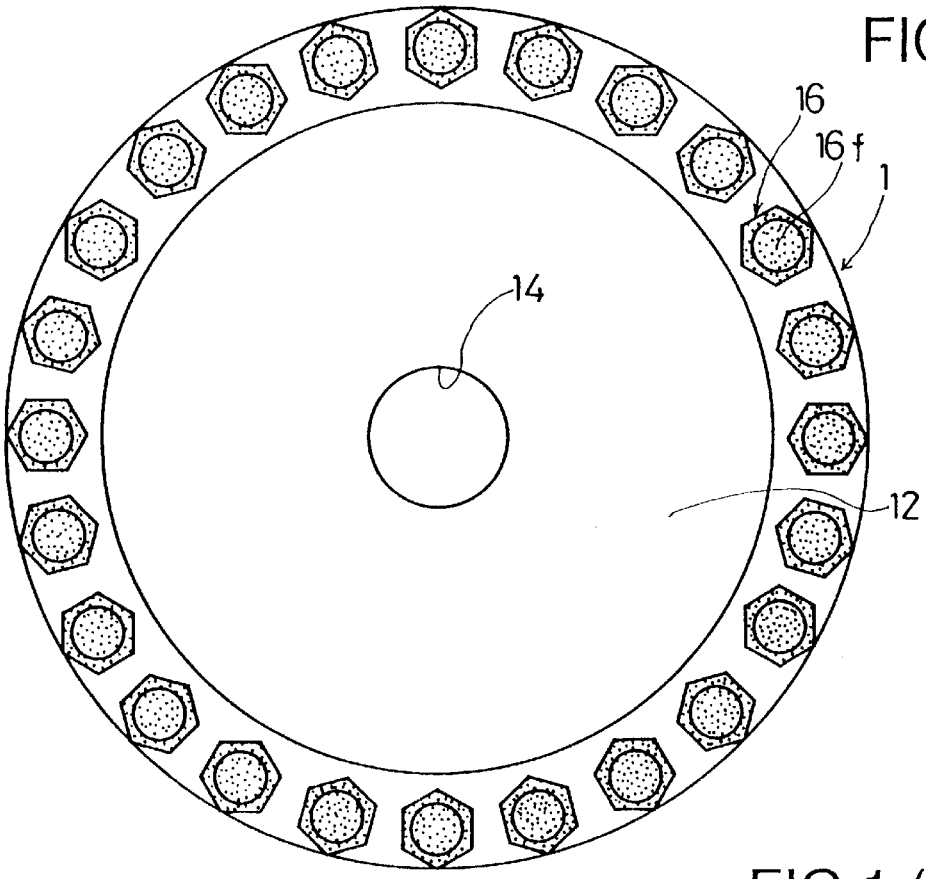
Figure 1:
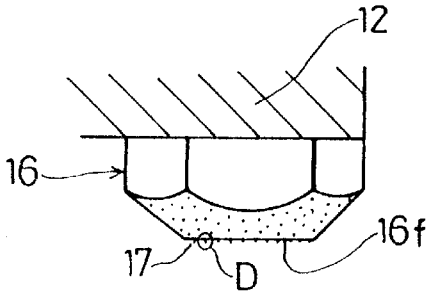
Figure 1:
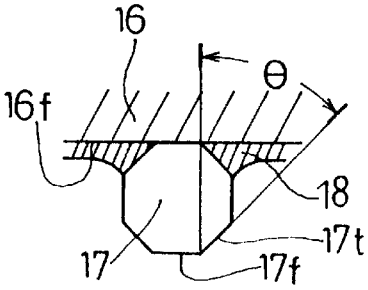
Figure 2:
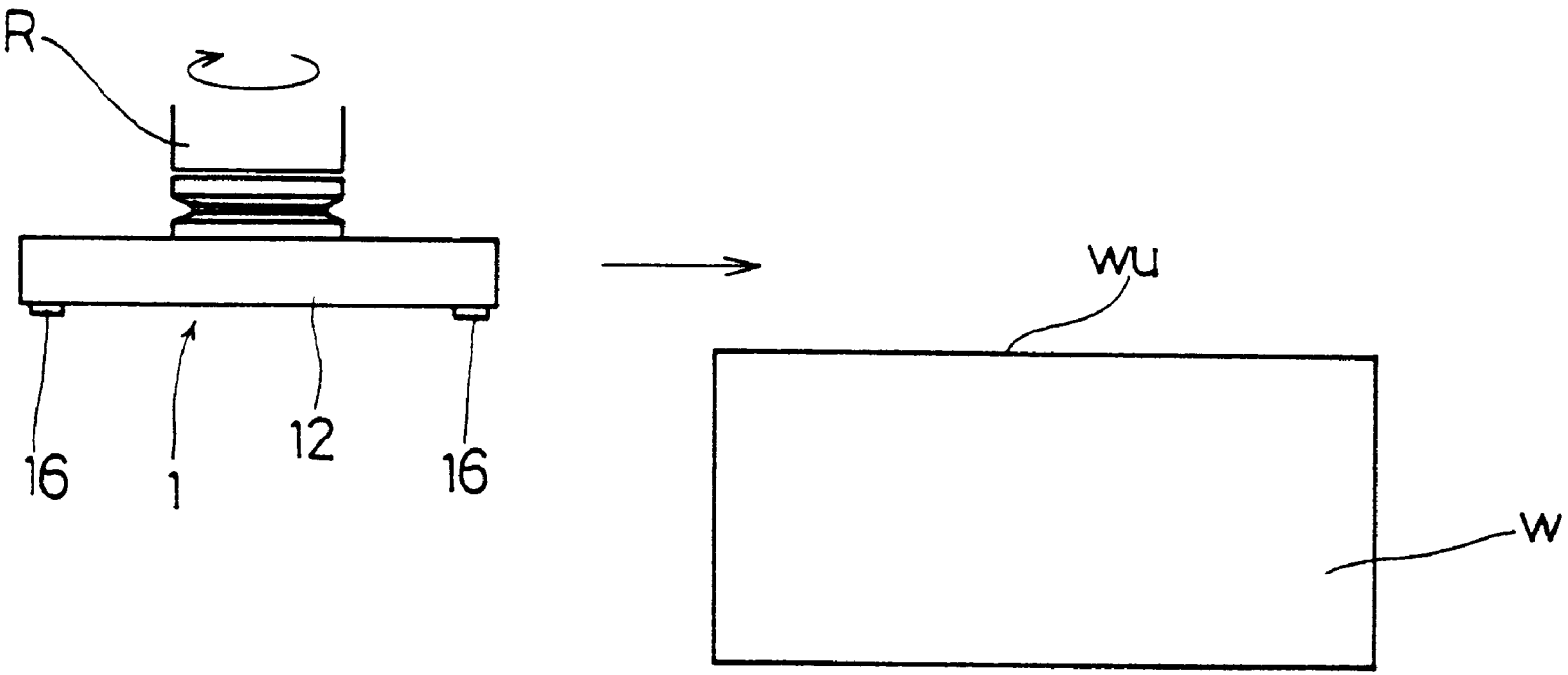
FIG. 2 is a side view of the grinder and cylinder block to be processed.
Figure 11:
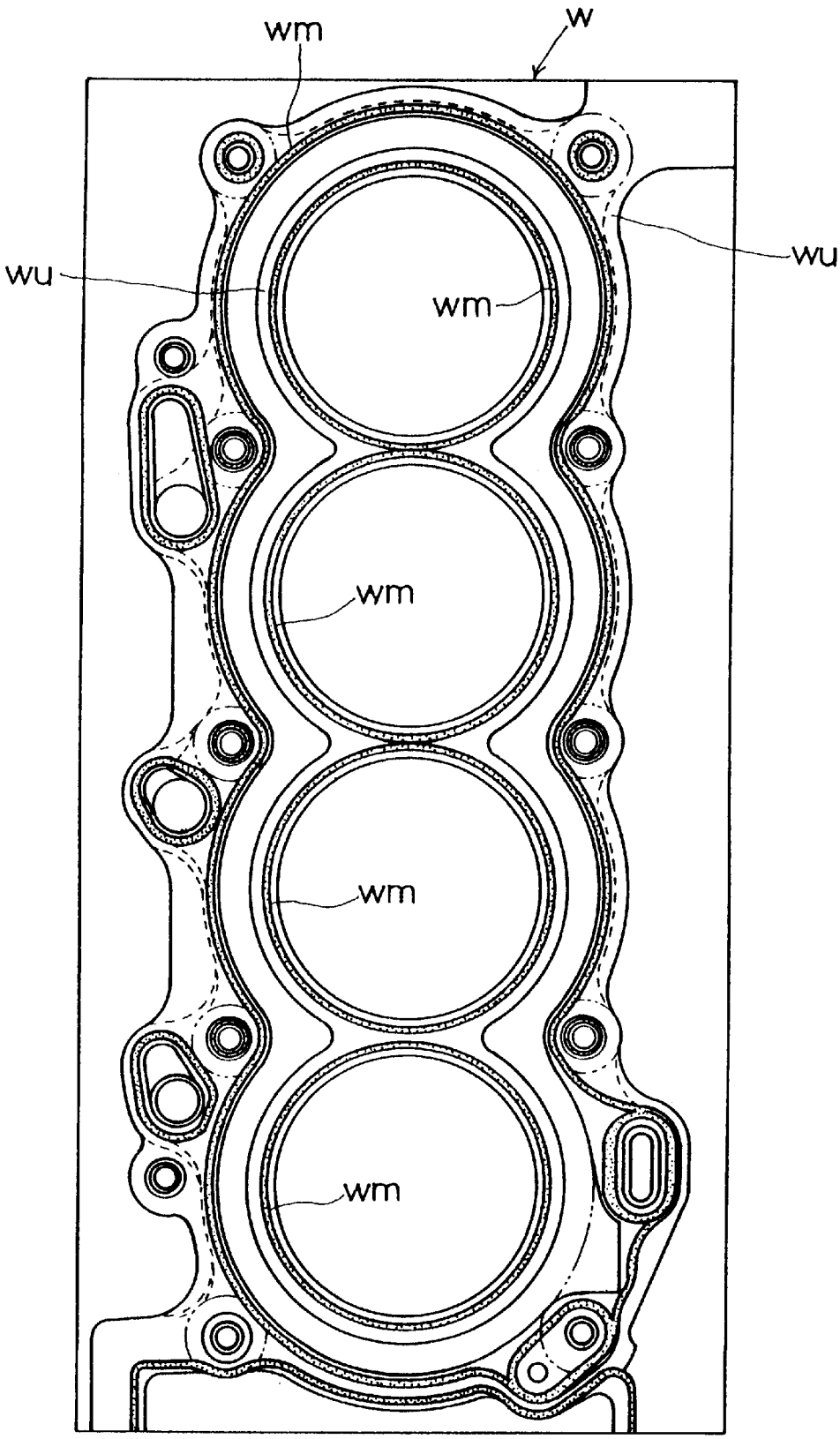
FIG. 11 is a plan view showing the sealing surface of the casting.

The sealing surface forming method of a first embodiment in accordance with the present invention will be described with reference to FIGS. 1(A) to 5. In the first embodiment, as shown in FIG. 2, an upper face or sealing surface wu of a cylinder block w serving as an aluminum casting is ground and simultaneously, casting defects present within a predetermined range of the depth of the casting from the sealing surface wu are effectively collapsed. FIG. 1(A) illustrates a grindstone 1 used in the method of the embodiment, and FIG. 2 schematically illustrates a manner of grinding and pressing. The sealing surface wu is shown in FIG. 11 in detail.

The grindstone 1 comprises a generally circular support plate or disk 12 having a central mounting hole 14 into which a rotational shaft R (see FIG. 2) of a grinder is fitted, as shown in FIG. 1. The disk 12 further has 24 bolt heads 16 fixed to a circumferential edge of the underside thereof at regular intervals. The heights of the bolt heads 16 fixed to the disk 12 are uniformed so that distal end faces 16*f* thereof are co-planar with one another or located on the same plane. Abrasive grains 17 each made of diamond are secured to the distal end face 16*f* of each bolt head 16 by a bond 18, as shown in FIG. 1(C) and FIG. 1(D), the latter of which figures is an enlarged view of portion D in the former.

Each of the diamond abrasive grains 17 is tooled by a diamond dresser so that the distal end face thereof (hereinafter, "flat face 17*f*") is formed into a flat configuration as shown in FIG. 1(D) and held on the same plane. That is, the flat faces 17*f* of all the abrasive grains 17 are co-planar with one another or located on the same plane. Each diamond abrasive grain 17 has an inclined face 17*t* formed around the flat face 17*f*. The inclined face 17*t* meets the flat face 17*f* at a negative rake angle θ.

Figure 6A:
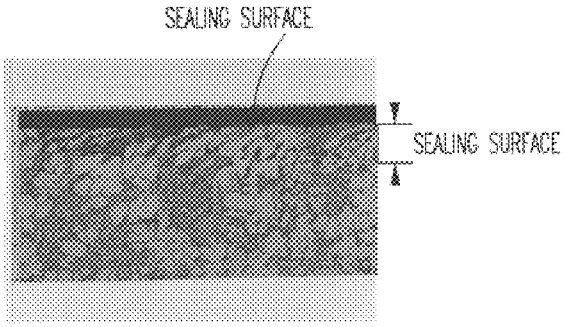
FIG. 6(A) is a photograph showing the sectional structure of the sealing surface formed by the method of the first embodiment in accordance with the present invention.

The method of processing the sealing surface of the casting with use of the grindstone 1 will now be described. First, the cylinder block w is positioned at a predetermined location. Then, as shown in FIG. 2, the grindstone 1 is moved horizontally while being rotated by the grinder (not shown) so that the upper surface of the cylinder block w is ground to be formed into the sealing surface wu with a depth of cut ranging between 0.1 mm and 0.2 mm. Thus, the sealing surface wu of the cylinder block w is ground by both of the flat face 17*f* and the inclined face 17*t* of each diamond grain 17. When the sealing face wu is ground while being scraped by the flat faces 17*f* of the diamond grains 17, as described above, the resistance of the sealing surface to the grinding is increased so that a plastic flow layer is formed on the sealing surface wu of the cylinder block w as shown in the photograph of FIG. 6(A). The formed plastic flow layer corresponds to a region of the casting where the aluminum forming the casting is pressed by the grindstone to be deformed. If any blowholes are present within a predetermined range of the depth of the casting from the sealing surface wu, these are efficiently collapsed as the result of formation of the plastic flow layer. More specifically, when the sealing surface wu is ground while the flat distal end faces 17*f* of the abrasive grains are abutted against the sealing surface parallel to the latter as shown in FIG. 1(D), the grinding by the abrasive grains and the pressing by the flat faces of the abrasive grains are simultaneously carried out. Consequently, the sealing surface is ground to be finished and simultaneously, the casting defects are pressed to be collapsed, whereby the casting defects are eliminated.

Figure 6B:
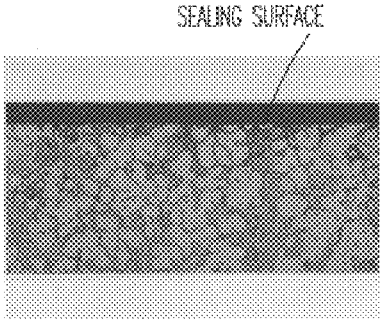
FIG. 6(B) is a photograph showing the sectional structure of the sealing surface formed by the milling.

FIG. 6(B) is a photograph showing the sectional structure in the vicinity of the sealing surface wu processed by way of milling. Casting defects cannot be eliminated from the milled sealing surface wu though it is rendered smooth.

An area of the flat face 17*f* of each diamond abrasive grain 17 is adjusted so that the roughness of the sealing surface wu of the cylinder block w is at or below 9 $\mu$Rz. When the roughness of the sealing surface exceeds 9 $\mu$Rz, each diamond grain 17 is tooled by the diamond dresser so that the area of flat face 17*f* thereof is increased.

Figure 3:
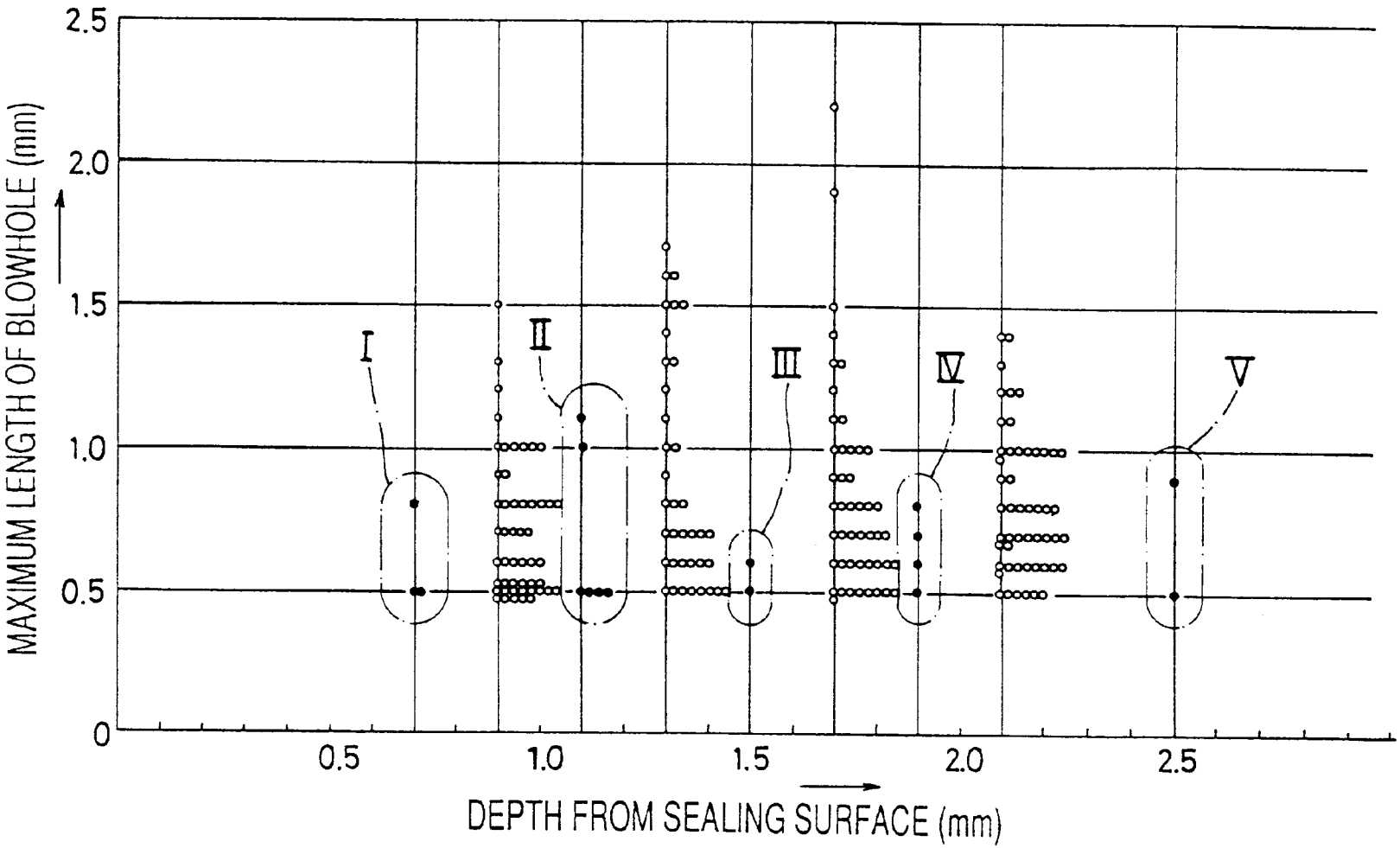
FIG. 3 is a graph of blowholes remaining in the sealing surfaces formed by the method of the first embodiment and by milling respectively.

FIG. 3 shows remaining blowholes both in a case where the sealing surface wu of the cylinder block w of sample No. 1 was ground by the grindstone 1 of the embodiment and in a case where the sealing surface wu of the cylinder block w of sample No.1 was milled. Each black dot in the graph represents a remaining blowhole in the grinding by the grindstone 1, and one black dot corresponds to one blowhole. Each void dot in the graph represents a remaining blowhole in the milling, and one void dot corresponds to one blowhole. The location of each dot denotes a maximum length of the blowhole and a depth from the sealing surface wu to the blowhole.

The conditions for the grinding were as follows. A rotational speed of the grindstone 1 was 2,500 rpm and a feed speed of the grindstone 1 was 500 mm/min in each of chain line enclosures I and II. The rotational speed of the grindstone 1 was 5,000 rpm and the feed speed of the grindstone 1 was 1,000 mm/min in enclosure III. The rotational speed of the grindstone 1 was 5,000 rpm and the feed speed of the grindstone 1 was 500 mm/min in each of enclosures IV and V. On the other hand, regarding the conditions for the milling, the rotational speed of a milling cutter was 2,000 rpm (cutting speed of 1,257 mm/min) and the feed speed of the milling cutter was 2,100 mm/min (feed per blade of 0.15 mm).

As apparent from FIG. 3, in the case of the milling, 50 blowholes each having the length of 0.5 mm or more remain at the depth of 0.9 mm, 37 blowholes at the depth of 1.3 mm, 47 blowholes at the depth of 1.7 mm, and 51 blowholes at the depth of 2.1 mm. On the other hand, when the sealing surface wu was ground by the grindstone 1 of the embodiment, the blowholes present within a predetermined range of the depth of the casting were efficiently collapsed as the result of formation of the plastic flow layer. Consequently, when the grindstone 1 was rotated at the speed of 2,500 rpm and fed at the speed of 500 mm/min, only three blowholes remain at the depth of 0.7 mm and only six blowholes remain at the depth of 1.1 mm. Furthermore, when the grindstone 1 was rotated at 5,000 rpm and fed at 1,000 mm/min, only two blowholes remain at the depth of 1.5 mm. Additionally, when the grindstone 1 was rotated at 5,000 rpm and fed at 500 mm/min, only four blowholes remain at the depth of 1.9 mm and only two blowholes remain at the depth of 2.5 mm.

Figure 4:
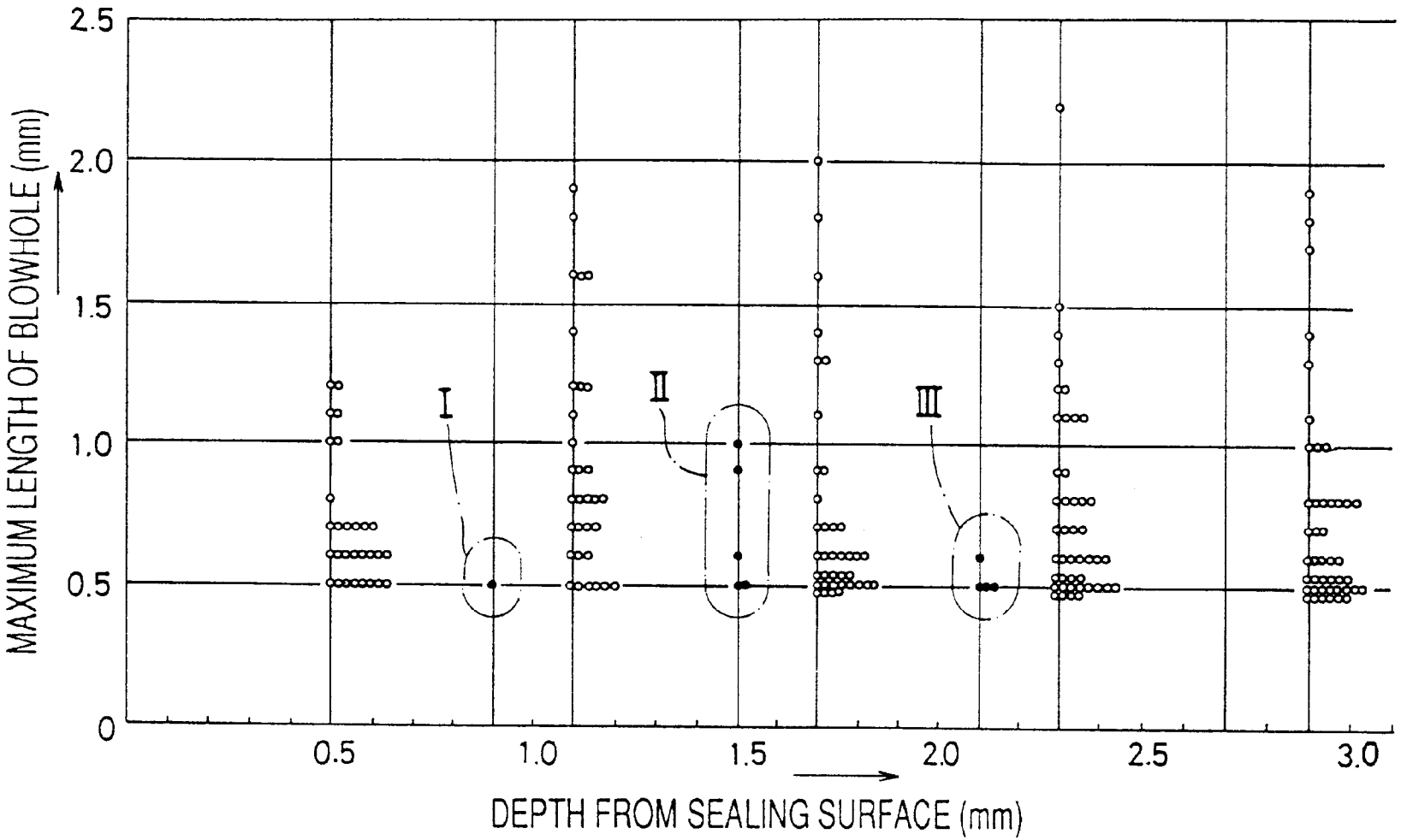
FIG. 4 is another graph of blowholes remaining in the sealing surfaces formed by the method of the first embodiment and by milling respectively.

FIG. 4 shows remaining blowholes both in a case where the sealing surface wu of the cylinder block w of sample No.2 was ground by the grindstone 1 of the embodiment and in a case where the sealing surface wu of the cylinder block w of sample No.2 was milled. The conditions for the milling were the same as those in the case shown in FIG. 3.

As apparent from FIG. 4, in the case of the milling, 29 blowholes each having the length of 0.5 mm or more remain at the depth of 0.5 mm, 32 blowholes at the depth of 1.1 mm, 38 blowholes at the depth of 1.7 mm, 44 blowholes at the depth of 2.3 mm, and 44 blowholes at the depth of 2.9 mm. On the other hand, when the grindstone 1 of the embodiment was rotated at 8,000 rpm and fed at 1,000 mm/min, only one blowhole remains at the depth of 0.9 mm. Furthermore, when the grindstone 1 was rotated at 6,000 rpm and fed at 800 mm/min, only five blowholes remain at the depth of 1.5 mm. Additionally, when the grindstone 1 was rotated at 6,000 rpm and fed at 1,000 mm/min, only four blowholes remain at the depth of 2.1 mm.

Figure 5:
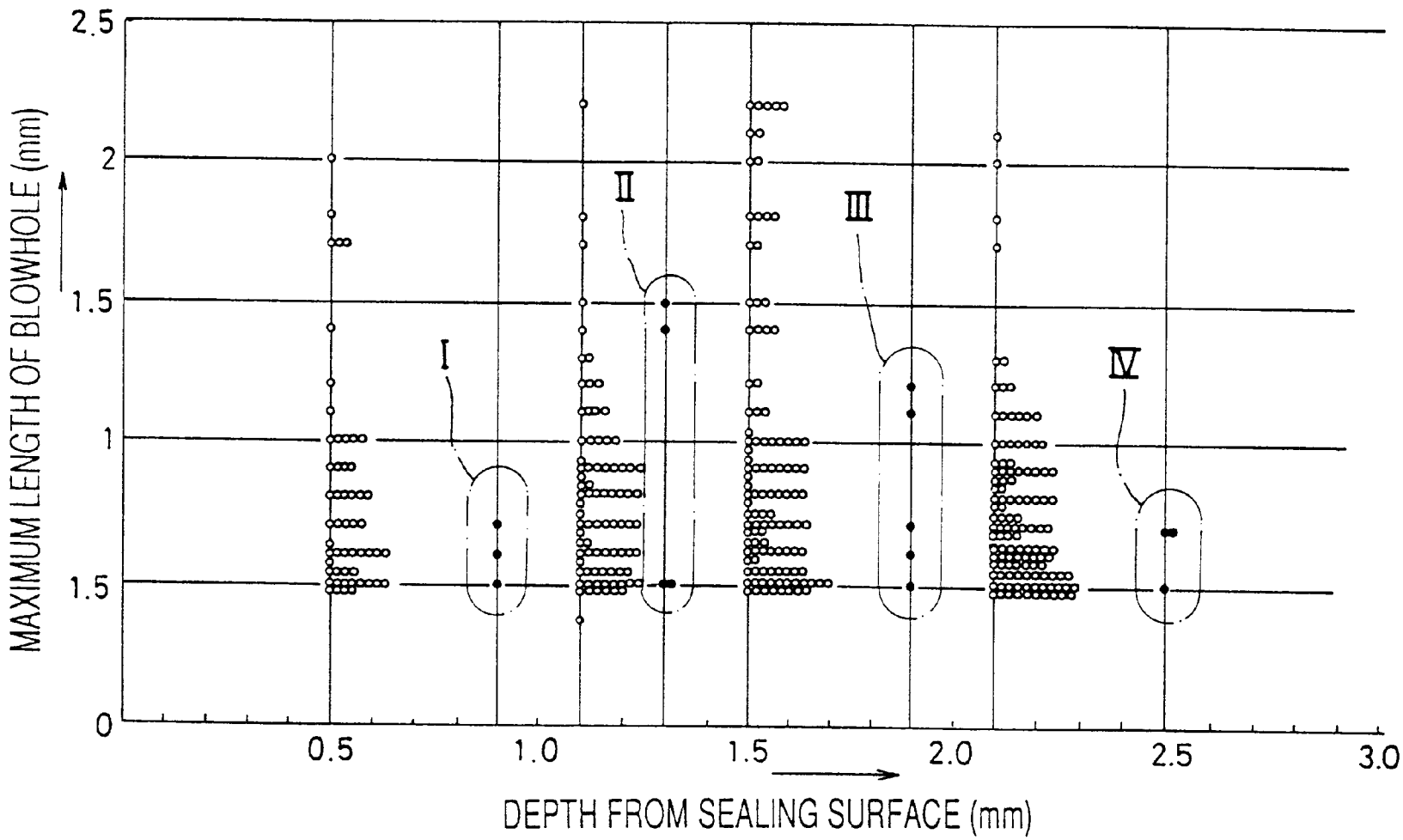
FIG. 5 is further another graph of blowholes remaining in the sealing surfaces formed by the method of the first embodiment and by milling respectively.

FIG. 5 shows remaining blowholes both in a case where the sealing surface wu of the cylinder block w of sample No.3 was ground by the grindstone 1 of the embodiment and in a case where the sealing surface wu of the cylinder block w of sample No.3 was milled. The conditions for the milling were the same as those in the case shown in FIG. 3.

As apparent from FIG. 5, in the case of the milling, 54 blowholes each having the length of 0.5 mm or more remain at the depth of 0.5 mm, 83 blowholes at the depth of 1.1 mm, 112 blowholes at the depth of 1.5 mm, and 118 blowholes at the depth of 2.1 mm. On the other hand, when the grindstone 1 of the embodiment was rotated at 6,000 rpm and fed at 800 mm/min, only three blowholes remain at the depth of 0.9 mm. Furthermore, when the grindstone 1 was rotated at 6,000 rpm and fed at 800 mm/min, only five blowholes remain at the depth of 1.5 mm, only four blowholes at the depth of 1.3 mm, only five blowholes at the depth of 1.9 mm, and only three blowholes at the depth of 2.5 mm.

According to the above-described embodiment, the casting defects present in the cylinder block w used under the high temperature conditions can reliably eliminated since the blowholes are collapsed by forming the plastic flow layer on the sealing surface wu of the cylinder block w. Moreover, shrinkage cavities with a certain range of size can also be eliminated by the above-described method regardless of their configurations. Consequently, the number of remaining blowholes can be reduced to a large extent.

Figure 7:
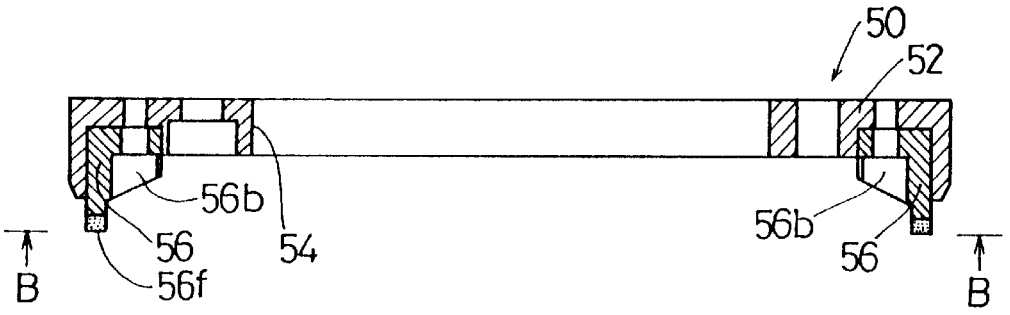
FIG. 7(A) is a longitudinal section of another grindstone used in the method of the first embodiment in accordance with the present invention.
FIG. 7(B) is a view of the grindstone as viewed in the direction of arrows B in FIG. 7(A)
FIG. 7(C) is a partially enlarged view of the grindstone of FIG. 7(A)
FIG. 7(D) is a partially enlarged view of the grindstone of FIG. 7(C)
Figure 7:
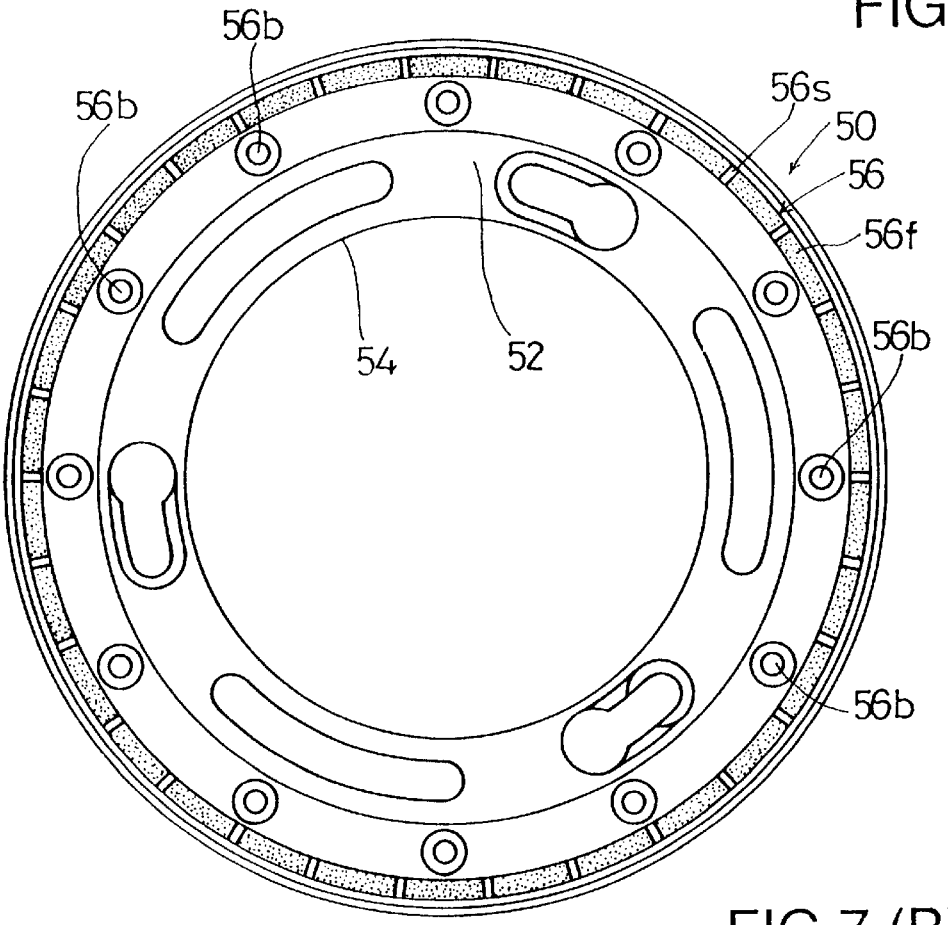
Figure 7:
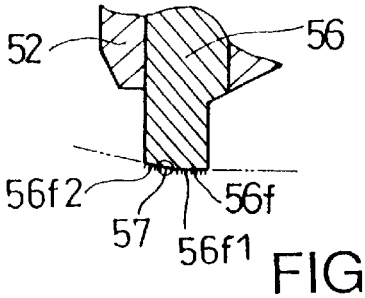
Figure 7:
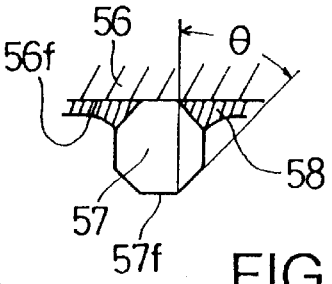

FIG. 7 illustrates another grindstone used in the method of the first embodiment. A grindstone 50 comprises a disk 52 having a central mounting hole 54 into which the rotational shaft R (see FIG. 2) of the grinder is fitted. A cylindrical ring member 56 is fixed by a plurality of bolts **56*b* to the circumferential edge of the underside of the disk 52 so as to be coaxial therewith. A lower end face 56*f* of the ring member 56 includes an inner circumferential portion 56*f*1 formed to be parallel to the disk 52 and a slightly inclined outer circumferential portion 56*f*2, as best shown in FIG. 7(C). A plurality of diamond abrasive grains 57 are secured by a suitable bond 58 to the lower end face 56*f* of the ring member 56 as shown in FIGS. 7(C) and 7(D). A plurality of radially extending slits 56*s* are also formed at predetermined intervals in the lower end face 56*f* of the ring member 56. The diamond abrasive grains 57 are processed so as to have the same configuration as the above-described diamond abrasive grains 1. Flat faces 57*f* of all the abrasive grains 57 fixed to the inner circumferential portion 56*f*1** are co-planar with one another or located on the same plane.

The sealing surface wu of the cylinder block w is processed by the grindstone 50 substantially in the same manner as described above, and the same effect can be achieved as described above.

Second Embodiment

Figure 8:
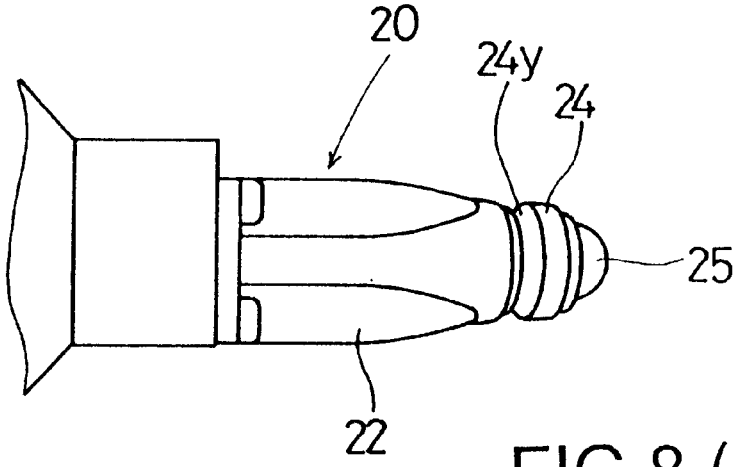
FIG. 8(A) is a side view of a pressing tool used in the method of a second embodiment in accordance with the present invention.
FIG. 8(B) is an enlarged view showing a distal end of the pressing tool of FIG. 8(A)
Figure 8:
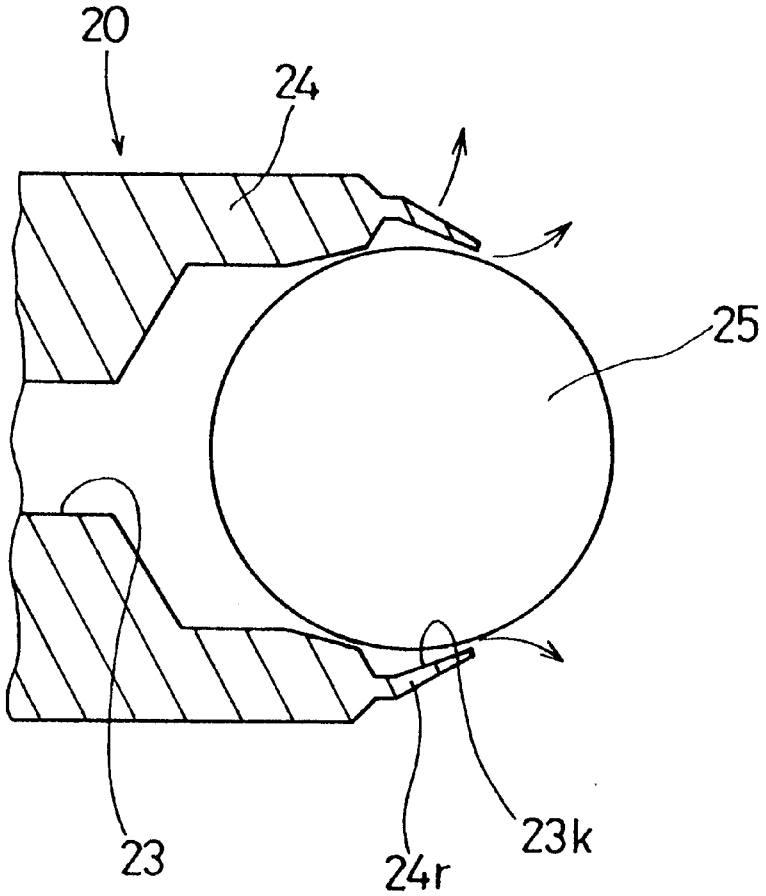
Figure 9:
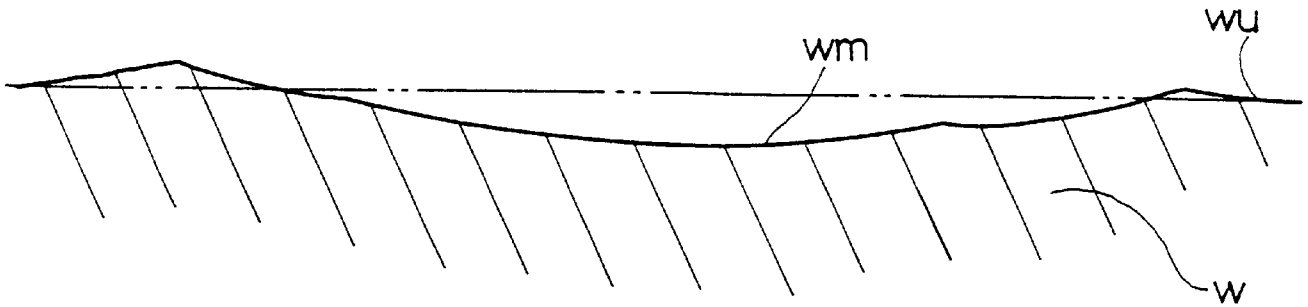
FIGS. 9(A), 9(B) and 9(C) are sectional views of the sealing surface formed by the method of the second embodiment.
Figure 9:
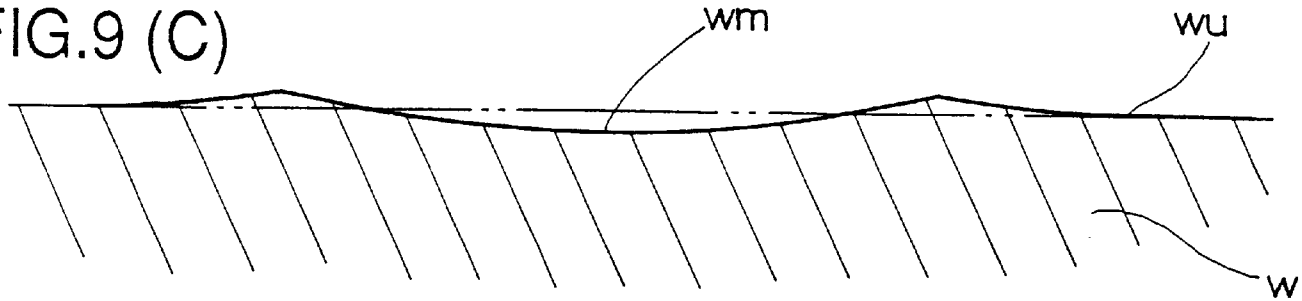
Figure 9:
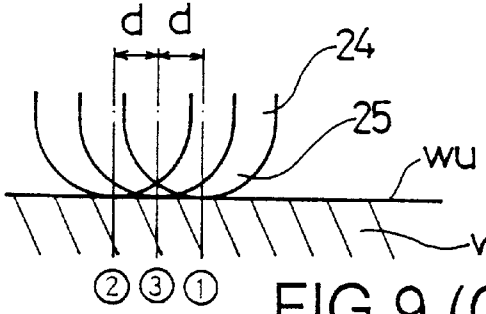
Figure 10:
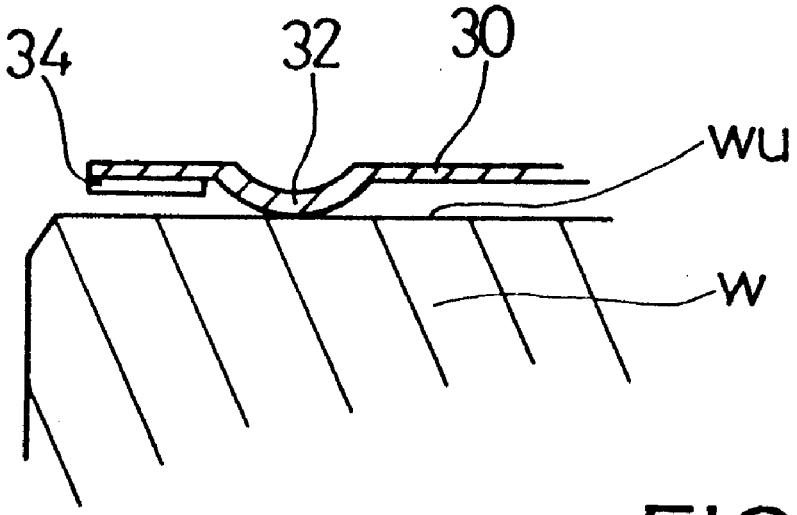
FIG. 10(A) is a longitudinal section of a flat sealing surface to which a gasket is attached.
FIG. 10(B) is a longitudinal section of the sealing surface formed by the method of the second embodiment with a gasket being attached thereto.
Figure 10:
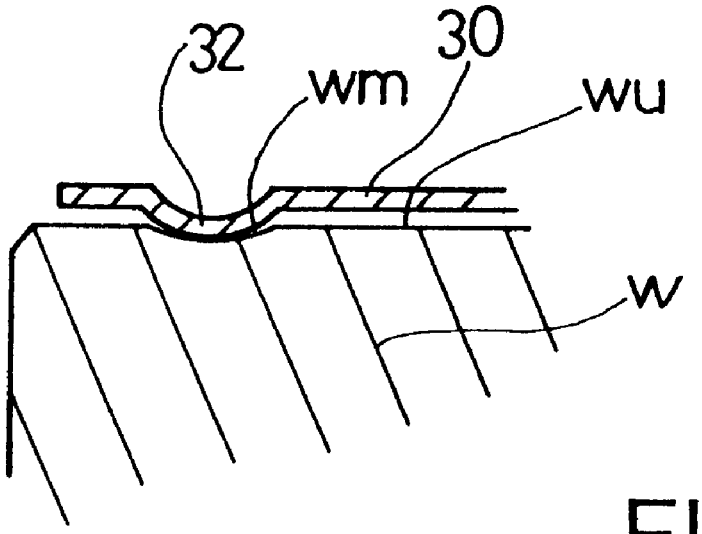

A second embodiment of the invention will be described with reference to FIGS. 8(A) to 11. In the second embodiment, the sealing surface wu of the cylinder block w serving as the aluminum casting is pressed along a seal line of a gasket serving as a sealing member by a pressing tool 20 so that the casting defects present within the predetermined range of the depth of the casting from the sealing surface are eliminated. FIGS. 8(A) and 8(B) are side and partially enlarged sectional views of the pressing tool, and FIGS. 9(A) to 9(C) are configurations of the sealing surfaces wu pressed by the pressing tool respectively.

The pressing tool 20 includes a mount section 22 mounted on a hand of an industrial robot or a spindle of a machine tool, neither of which is shown, and a movable section 24 attached to an articulated portion **24*y* further attached to a distal end of the mount section 22. The interior of the mount section 22 provides a space (not shown) for accommodating a high-pressure liquid. The space communicates with a through hole 23 extending axially with respect to the movable section 24. The hole 23 of the movable section 24 includes a distal end portion having a larger diameter than the other portion thereof. A ceramic ball 25 for pressing a workpiece is rotatably accommodated in the distal end portion of the hole 23 so as to close the open end of the hole. The movable section 24 further includes a presser ring 24*r* formed on a distal end thereof for holding the ball 25 in the hole 23**.

When the workpiece is not pressed by the ball 25, the pressure of the liquid contained in the space causes the ball 25 to abut against a conical surface **23*k* of the presser ring 24*r* so that the ball 25 is held in its farthest projected state. When the ball 25 presses the workpiece and is then subjected to a reactive force larger than the liquid pressure, the ball is departed from the presser ring 24*r* and axially displaced in the hole 23 to be held only by the liquid pressure. Accordingly, the workpiece can be pressed by the liquid pressure when the ball 25 is caused to depart from the presser ring 24***r*.

The processing for the sealing surface by use of the pressing tool 20 will now be described. First, the cylinder block w is positioned at a predetermined location. The robot to which the pressing tool 20 is attached is then driven to press the ball 25 held in the movable section 24 of the tool against the sealing surface wu of the cylinder block w. The pressure of the liquid supplied to the pressing tool 20 is maintained at 40 MPa (about 400 kg/cm2). The ball 25 is then moved along a portion wm of the sealing surface adjacent to the seal line of a gasket 30 (see FIGS. 10(A) and 10(B)) while the ball 25 being subjected to the liquid pressure is pressing the sealing surface wu. The portion wm will hereinafter be referred to as "seal portion wm." The speed at which the ball 25 is moved is set at 1,000 mm/min.

FIG. 9(B) shows a profile curve of the sealing surface wu when the ball 25 has once been moved along the seal portion wm in the manner as described above. The sealing surface wu is plastically deformed by a one-time processing into the shape of a shallow groove with a depth of 0.12 mm. The two-dot chain line in FIG. 9(B) represents the sealing surface wu before execution of the processing.

FIG. 9(A) shows another profile curve of the sealing surface wu when the processing has been executed three times. In this case, as shown in FIG. 9(C), an outer portion of the cylinder block w is pressed in the first processing. The pressing tool 20 is inwardly displaced by a distance of 2×d (3 mm) so that an inner portion of the cylinder block w is pressed in the second processing. The pressing tool 20 is then outwardly displaced by a distance of d (1.5 mm) so that a central portion of the cylinder block w is pressed in the third processing. Upon execution of the pressing at three times, the seal portion wm is plastically deformed into the shape of a shallow groove with a depth of 0.26 mm. Consequently, the blowholes present within a predetermined range of the depth from the seal portion wm are collapsed such that the casting defects are eliminated.

Upon completion of the processing for the sealing surface wu of the cylinder block w, a protrusion or bead portion 32 of the gasket 30 is put on the plastically deformed seal portion wm. Subsequently, a cylinder head (not shown) is set on the gasket 30 and then bolted to the cylinder block w. As a result, the bead portion 32 of the gasket 30 is flexed so that a seal is provided between the cylinder head and the cylinder block w. Thus, the gasket 30 serves as a sealing member.

According to the method of the second embodiment, the casting defects present in the cylinder block w used under the high temperature conditions can reliably be eliminated since the seal portion wm of the sealing surface wu is pressed by the ball 25 of the pressing tool 20 so that the blowholes present within the predetermined range of the depth are collapsed. Moreover, shrinkage cavities with a certain range of size can also be eliminated by the above-described method regardless of their configurations. Additionally, since only the seal portion wm of the sealing surface wu is pressed, energy required for the processing can be reduced and strain of the cylinder block w can be decreased.

Furthermore, the seal portion wm is plastically deformed into the shape of a groove so that the bead portion 32 of the gasket 30 can be set therein. Consequently, the gasket 30 can readily be positioned. Additionally, a stopper 34 as shown in FIG. 10(A) is necessary to prevent the bead portion 32 from vending forward when the seal portion wm is flat. However, no such stopper is required in the second embodiment. Consequently, the cost of the gasket 30 can be reduced, and bores of the cylinder block w can be prevented from being deformed due to a surface pressure of the stopper 34.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

What is claimed is:

1. A method of processing a sealing surface of a casting to eliminate casting defects on or in the vicinity thereof, the method comprising the step of pressing a grindstone having abrasive grains with distal end surfaces against the sealing surface while the grindstone is being rotated, the grindstone being abutted against the sealing surface so that the distal end surfaces of abrasive grains of the grindstone are held approximately parallel to the sealing surface.

2. The method according to claim 1, wherein each abrasive grain is abutted against the sealing surface at a negative rake angle.

3. The method according to claim 1, wherein the grindstone is rotated within a plane parallel to the sealing surface.

4. The method according to claim 1, wherein the grindstone is rotated and moved within a plane parallel to the sealing surface.

* * * * *